US007695417B2

(12) United States Patent
Canali

(10) Patent No.: US 7,695,417 B2
(45) Date of Patent: Apr. 13, 2010

(54) GYM APPARATUS

(76) Inventor: Vincenzo Canali, Via Carpaneto 78, 43028 Tizzano Val Parma (IT)

( * ) Notice: Subject to any disclaimer, the term of this patent is extended or adjusted under 35 U.S.C. 154(b) by 0 days.

(21) Appl. No.: 10/558,823

(22) PCT Filed: Mar. 29, 2004

(86) PCT No.: PCT/IT2004/000155

§ 371 (c)(1),
(2), (4) Date: Nov. 29, 2005

(87) PCT Pub. No.: WO2004/108222

PCT Pub. Date: Dec. 16, 2004

(65) Prior Publication Data

US 2007/0021281 A1 Jan. 25, 2007

(30) Foreign Application Priority Data

Jun. 5, 2003 (IT) ..... MI2003A1132

(51) Int. Cl.
*A63B 26/00* (2006.01)

(52) U.S. Cl. ..... 482/142

(58) Field of Classification Search ..... 482/142, 482/92–103, 148, 140, 139, 23, 51
See application file for complete search history.

(56) References Cited

U.S. PATENT DOCUMENTS

| | | | | | |
|---|---|---|---|---|---|
| 1,311,255 | A | * | 7/1919 | Beckman | 2/239 |
| 1,344,255 | A | | 6/1920 | Beckman | |
| 3,589,358 | A | * | 6/1971 | Megal | 606/244 |
| 4,103,681 | A | * | 8/1978 | Shanley | 606/244 |
| 4,214,790 | A | * | 7/1980 | Sieber | 297/326 |
| 4,423,862 | A | * | 1/1984 | Hewitt | 482/130 |
| 5,669,865 | A | * | 9/1997 | Gordon | 482/142 |
| 5,669,868 | A | * | 9/1997 | Markoll | 600/14 |
| 7,150,702 | B2 | * | 12/2006 | Webb et al. | 482/130 |

FOREIGN PATENT DOCUMENTS

| | | | |
|---|---|---|---|
| FR | 2570274 | A * | 3/1986 |
| GB | 2372711 | A * | 9/2002 |

* cited by examiner

*Primary Examiner*—Lori Baker
(74) *Attorney, Agent, or Firm*—Modiano & Associati; Albert Josif; Daniel J. O'Byrne

(57) ABSTRACT

A gym apparatus for exercising different muscle groups. Operating the apparatus according to the invention, the user is positioned on a support table which is made to rotate at a pivoted point of the table. This involves beneficial effects for the blood circulation of the user.

10 Claims, 7 Drawing Sheets

GYM APPARATUS

BACKGROUND OF THE INVENTION

The present invention refers to an improved gym apparatus which excercises different muscle groups and allows the user a rotating movement in his own space during execution of the exercise. At this moment in time some apparatus exist allowing substantial movement in the users space during performance of the exercise. For example, when operating the rower, the user moves horizontally backwards and forwards on an opportune mobile seat while strengthening dorsal muscles.

Other apparatus permit the exercise in vertical traction to become easier by using a lighter platform on which the user stands. In this case movement is purely vertical. This way however, the user does not execute a rotating movement in his own space, so, therefore, does not receive any benificial effects regarding the blood circulation.

The general outcome of the present invention, is to improve the aspects mentioned above, by supplying a gym apparatus permitting different groups of muscles to exercise, allowing a substantial rotating movement within the users space.

Considering this outcome, a gym apparatus has been produced, according to the invention, where the user is opportunely positioned on a support-table which is rotated by a pivot. This involves, as already stated, positive effects on the blood circulation during the execution of the technical exercise of every muscular group.

BRIEF SUMMARY OF THE INVENTION

These, and further purposes are reached, according to the invention of a gym apparatus consisting of:

A support table to sustain the user, which are ten both sustained on a horizontal axis rotated by a pivot. The present axis being situated in comparison to the support-table, which is loaded by the users weight, allows him, following a pre-arranged rotation, to reach a point of equilibrium.

A mobile element, in respect to the table, available with the users hands or feet positioned on the support-table. The mobile element, being attached to the said support-table by a kinematic connections sends away the table, loaded by the user, from its position of equilibrium and rotates around the pivoted horizontal axis when the element is moved by the users in respect to the support-table.

To enable the explanation of the innovative principles of the present invention and its advantages, in comparison to the known technique to be clearer, they will be described with the help of the attached drawings. Examples of two possible embodiments with the application of such principles are shown in the drawings.

DETAILED DESCRIPTION OF THE INVENTION

Figure 1:
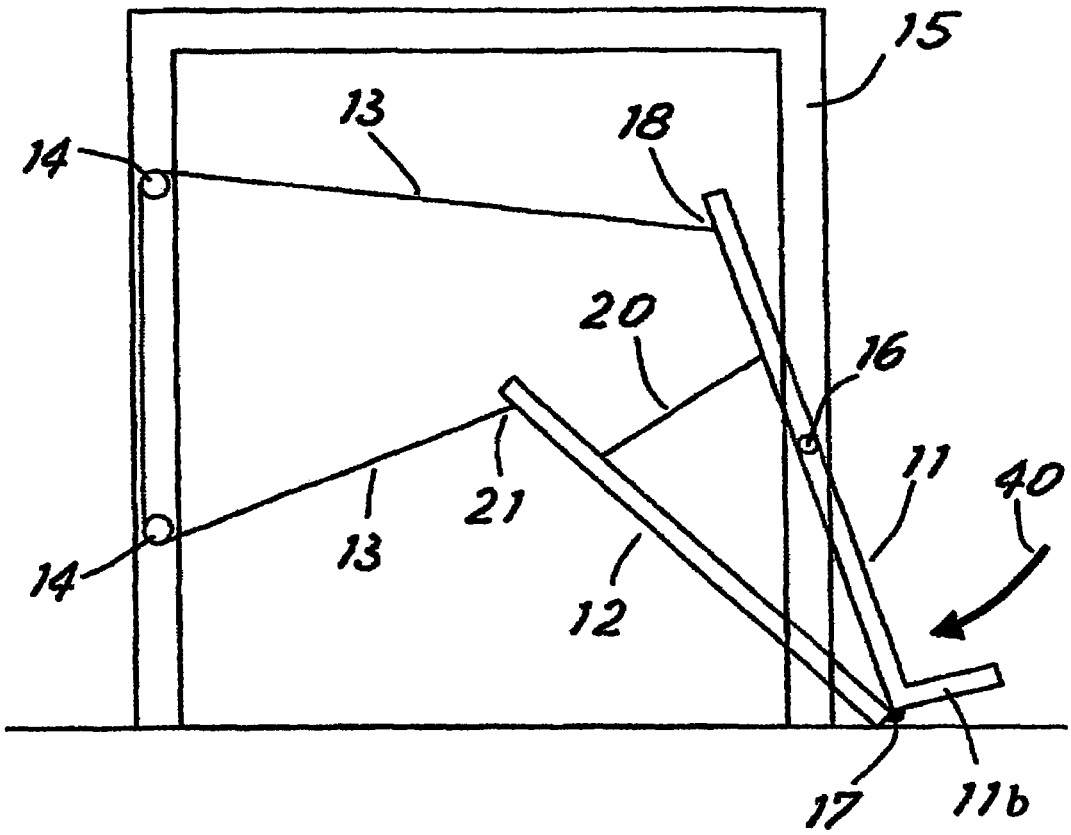
FIG. 1 Represents a side view of a 1st realization of the gym apparatus, according to the invention in the initial rest position.

FIG. 1 Shows a 1st realization of the gym apparatus to the suitable invention for the exercising of the dorsal muscles and biceps. This apparatus consists of a support-table 11, on which the user lays face down, a handle 12, a rope 13, two pulleys 14 and the support structure 15. The support-table is endowed with a platform 11*b* that permits the user to correctly position himself on the table. The table is attached to the support-structure 15 through a horizontally rotating axis. This pivot is situated in comparison to the table 11, in a position for which the table, loaded by the users weight, allows the tendency to acquire a vertical position according to the sense of rotation shown by the arrow 40 in FIG. 1.

The handle 12 is attached to the table 11 by a horizontally pivoted axis 17 and the possibility of inclination in respect to the table 11, limits its correct reaction exemplified with an extendible connecting rod 20.

The rope 13, is connected to the table 11 at points 18, 12, 21 and is suspended by the pulleys 14 that are fixed to the support-structure 15 as shown in the design.

We pass on to the functional description. In the initial rest-position (FIG. 1) the user lays face-clown on the table 11 which touches the ground with its extremity. The flexible connecting rod 20 is taut Ibis position is of table equilibrium.

Figure 2:
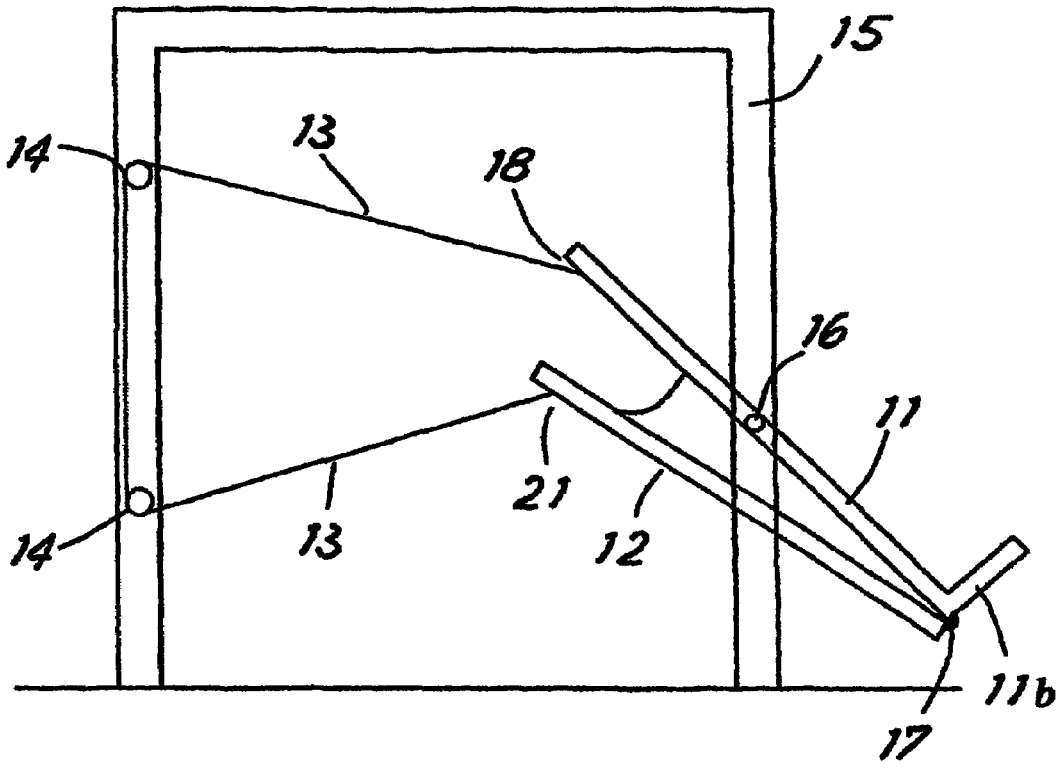
FIG. 2 Represents a side view of FIG. 1 in the final position of maximum muscular contraction.
Figure 3:
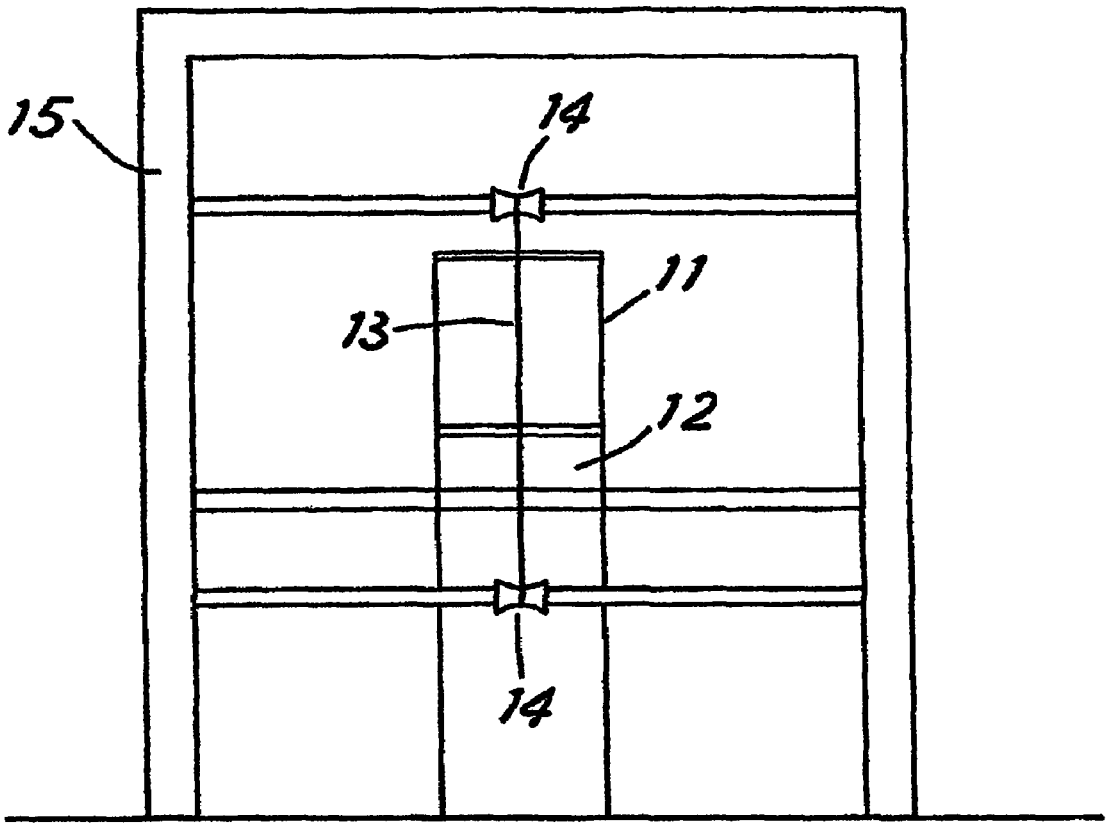
FIG. 3 Represents a frontal view in rest position.

When the user, laying face down on the table 11, grasps the handle 12, and pulls it towards himself, the rope 13, becomes taut, which allows the table 11, to return to its initial position of equilibrium making it rotate around the pivot 16 as shown in FIG. 2

You also note that the necessary strength for the exercise to function is related to the weight of the user in a proportional way. Also, the user is moved and rotated moving himself from the almost vertical initial position FIG. 1 to the final tilted position FIG. 2. This involves beneficial effects regarding the blood circulation.

It is easily understood, by varying the distance between points 18 hooking of the rope, 13, and the pivot point 16, varies the arm during the tension of the rope 13 in respect to the pivot 16 and therefore the strength that the user must impose on the handle 12 to incline the table 11. Likewise, regularity of the users strength is obtained by varying the distance between point 21 and pivot point 17.

Besides varying the position of the pulleys 14 a plurality of functional characteristics are obtained allowing to vary the users strength and the maximum inclination attainable during use of the apparatus.

Figure 4:
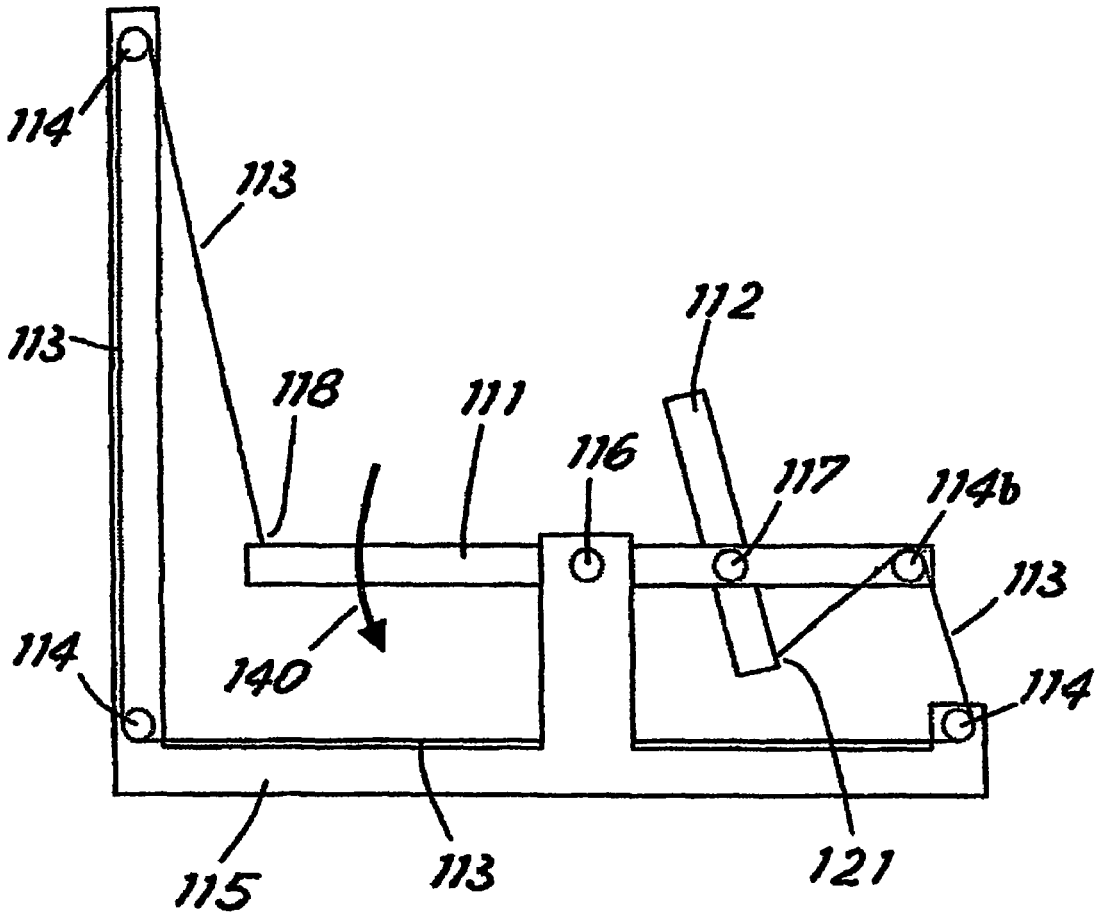
FIG. 4 Represents a side view of the 2nd realization of a gym apparatus according to the invention in the initial position.

There are different possibilities of varying this particular form of realization. For example: The kinematic connection between the table 11 and handle 12 described earlier as a rope 13 suspended by pulleys 14 can be replaced by an opportune system of levers or by a connection involving a funicular, without altering the function of the apparatus and its attainable purposes. Likewise, it is possible to imagine a realization of the invention characterized by the fact that the pivot point 16 of the table 11 may be varied in position allowing the user to regulate his strength and the inclination obtainable from the table during execution of the exercise. FIG. 4. Shows a 2nd realization of the invention to enable muscular exercise of the quadriceps. In this figure it is possible to visualise the support-table on which the user is layed in the supine position, the mobile element 112 which is attainable with the users feet whilst laying on the table, the rope 113, the 4 pulleys 114+114*b* and the support-structure 115.

The support-table 111 is attached to the support-structure 115 by a pivot with a horizontal axis 116. This pivot in respect to the table is situated in a position in which tha said table 111, weighted by the user, tends to advance towards the horizontal position according to the direction of rotation shown by the arrow 140 in FIG. 4. The mobile element 112 is attached to the table 111 by a horizontal axis pivot 117 and its inclination in respect to the table 111 is limited by adopted verifications (not shown in fig.). The rope 113 is connected at its extremes to the table 111 in point 118 and to the mobile element 117 in point 121 and is returned by the pulleys 114 fixed to the support-structure 115 and from the pulley 114 *b*, fixed to the support-table 111 as seen in the design.

Figure 5:
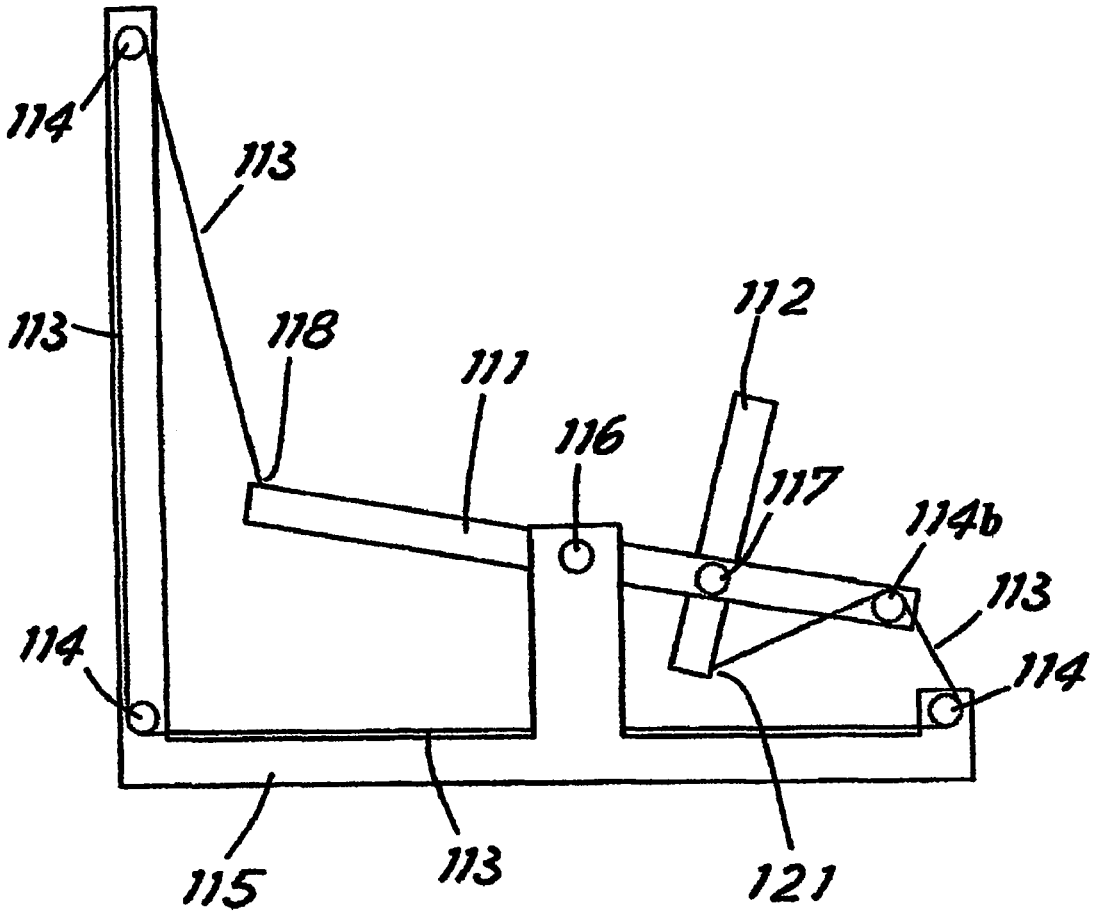
FIG. 5 Represents a side view of the realization of FIG. 4 in the final position of the exercise.
Figure 6:
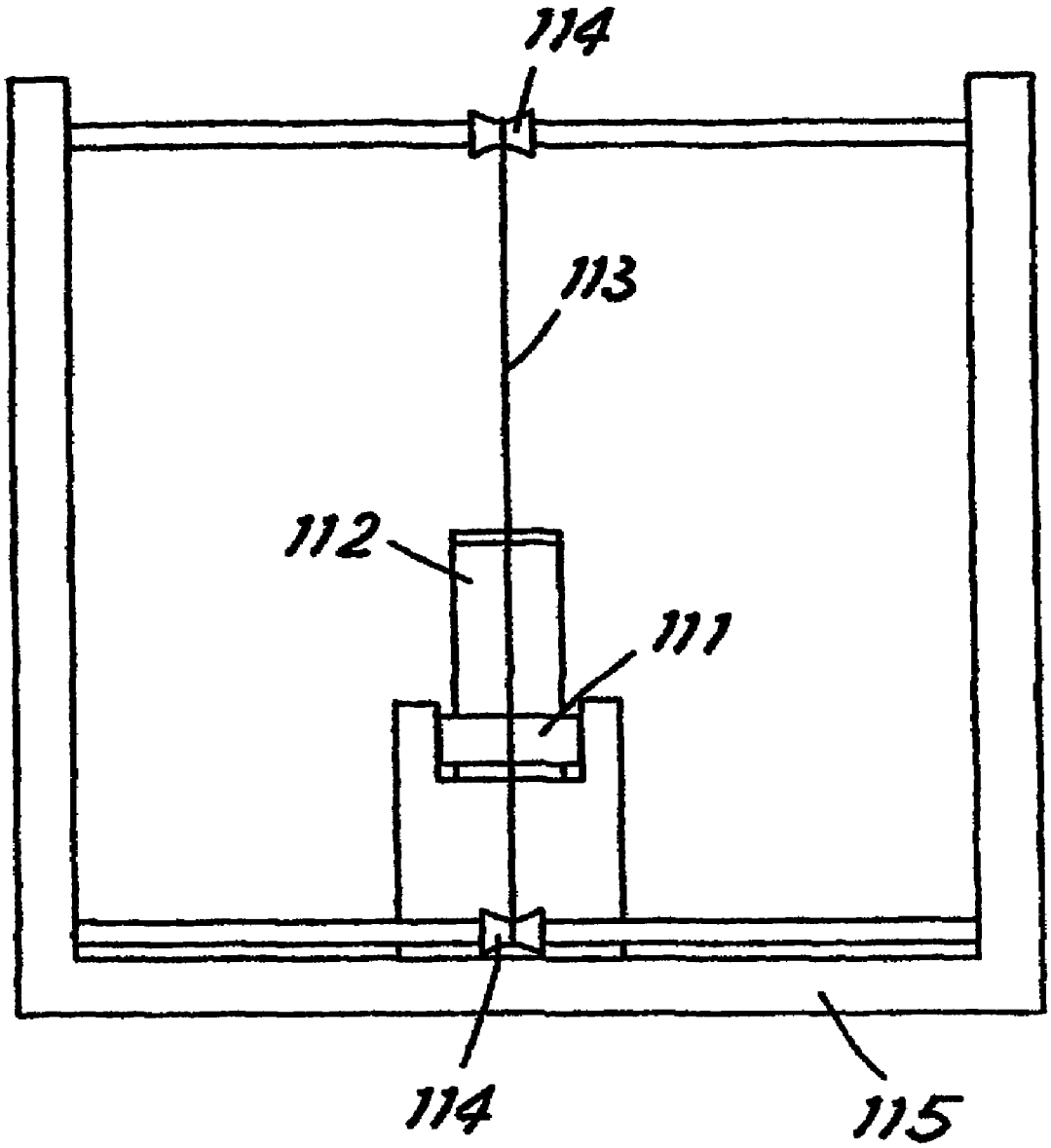
FIG. 6 Represents a frontal view of the realization of FIG. 4.
Figure 7:
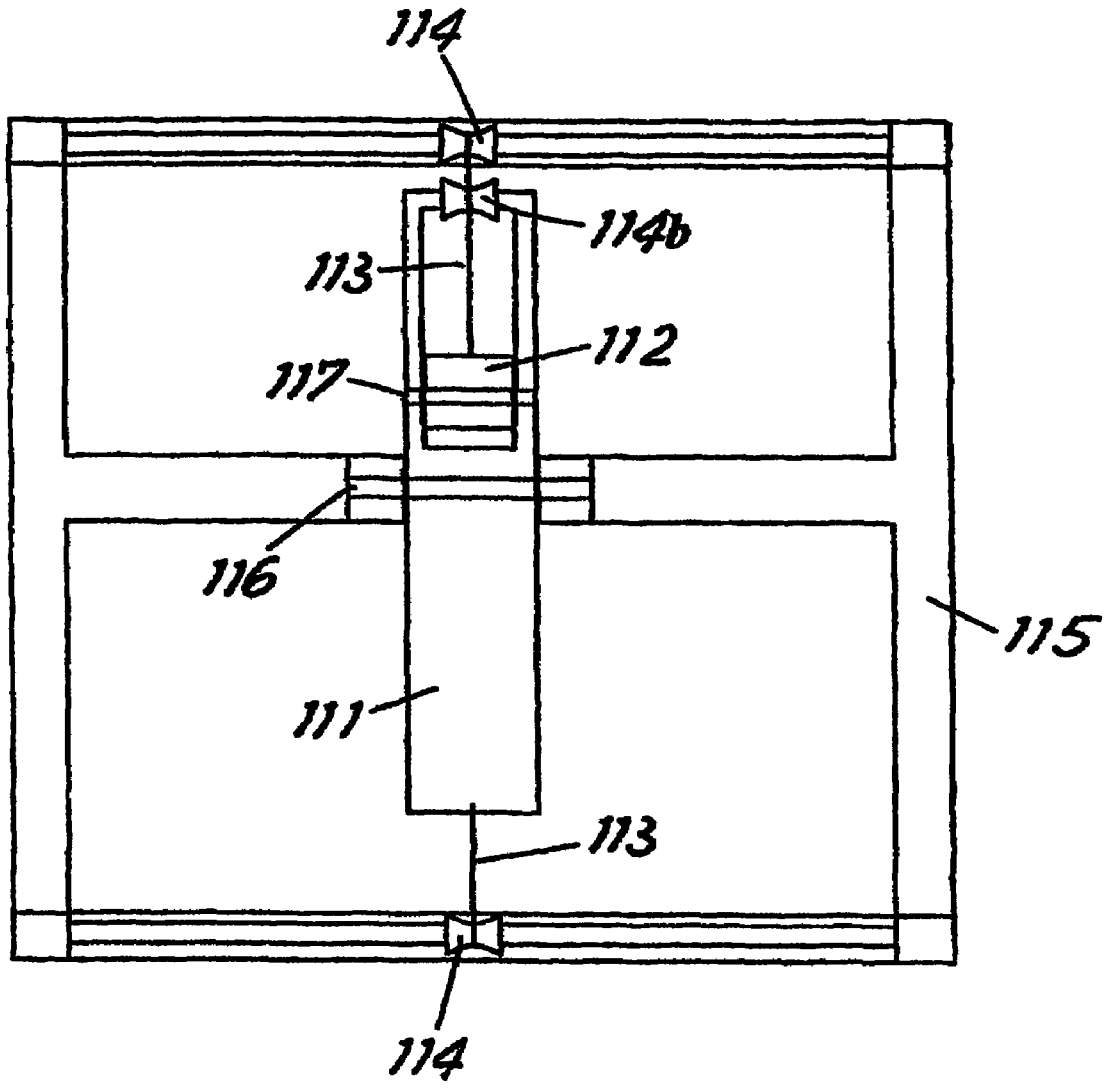
FIG. 7 Shows a view from above of the realization of FIG. 4.

We pass on to the functional description of the realization of the 2nd form:—in the initial rest position (FIG. 4), the user lays in the supine position on the table 111 with his head towards 118. The table 11 is in a horizontal position in stable equilibrium as the table 111 tends to rotate towards the arrow 140, but its rotation is limited by the structural limitation of the inclinability of the element 112 in respect to the said table 111. When the user, in the supine position, on the table 111 pushes the element 112 away from himself with his feet, the ropes tension that follow, moves the table 111 away from its initial position of equilibrium making it rotate around the pivot 116 as shown in FIG. 5. Also, in this case, the necessary needed for the result of the exercise, is related to the users weight in a proportional way. The user is rotated in his own space moving from the original horizontal position (FIG. 4) to the final inclined position (FIG. 5). This gives beneficial effects to the blood circulation.

Likewise to the first realized form described, varying the position of the hooking points 118 and 121 respectively to the table 111 and mobile element 112 the user is able to regulate the strength he needs to move the mobile element 112 to incline the table 111. Also by varying the positions of the pulleys 114, a plurality of characteristical functions are attained, permitting the user to vary his strength and the maximum inclination possible whilst exercising with this apparatus. Naturally, these two simplified descriptions are purely examples and must not be limited to any modifications of the support-structure here described.

The invention claimed is:

1. A gym apparatus, comprising:

a support structure;

a support-table adapted to support a user laying upon said support-table;

a first horizontal pivot that freely rotatably connects said support-table to said support structure such that during use of the gym apparatus said support-table is freely rotatable with respect to said support structure;

a mobile element which is mobile with respect to said support-table, a second horizontal pivot that freely rotatably connects said mobile element to said support-table such that during use of the gym apparatus said mobile element is freely rotable with respect to said freely rotating support-table and wherein said mobile element being positioned with respect to said support-table so as to be engageable by a user laying on said support-table to move said mobile element with respect to said support-table;

a rope, said rope being adjustably connected in position at a first selected adjustable connection point to said support-table, and said rope being adjustably connected in position at a second selected adjustable connection point to said mobile element whereby to select a variable strength required by a user to impose on said mobile element to incline said support-table; and a pulley system connected to said support structure, said rope winding around said pulley system.

2. The gym apparatus according to claim 1, wherein the pulley system is adjustably connected in position to said support structure whereby to vary a strength required by a user and a maximum attainable inclination of said support-table.

3. The gym apparatus according to claim 2, wherein the pulley system is further adjustably connected to the support-table.

4. The gym apparatus according to claim 1, wherein the support-table has an equilibrium position that is vertical.

5. The gym apparatus according to claim 1, wherein the support-table has an equilibrium position that is horizontal.

6. The gym apparatus according to claim 1, wherein the mobile-element is graspable by hand by a user when said user is positioned on the support-table.

7. The gym apparatus according to claim 1, wherein the mobile-element is engageable by foot by a user when said user is positioned on the Support-table.

8. The gym apparatus according to claim 1, wherein the support-table has an equilibrium position that is substantially vertical, and the mobile-element is graspable by hand by a user when said user is positioned on the support-table.

9. The gym apparatus according to claim 1, wherein the support-table has an equilibrium position that is horizontal, and the mobile-element is engageable by foot by a user when said user is positioned on the support-table.

10. The gym apparatus according to claim 1, wherein a position of said first horizontal pivot is adjustable for regulating a user's strength requirements and an inclination obtainable by said support-table.

* * * * *